US011754943B2

(12) United States Patent
Sugiyama

(10) Patent No.: US 11,754,943 B2
(45) Date of Patent: Sep. 12, 2023

(54) DEVELOPER SUPPLYING APPARATUS THAT COMMUNICATES WITH WIRELESS TAG, IMAGE FORMING APPARATUS, AND DEVELOPER STORAGE CONTAINER

(71) Applicant: KYOCERA Document Solutions Inc., Osaka (JP)

(72) Inventor: Yuichi Sugiyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/893,867

(22) Filed: Aug. 23, 2022

(65) Prior Publication Data

US 2023/0067852 A1 Mar. 2, 2023

(30) Foreign Application Priority Data

Aug. 24, 2021 (JP) ..... 2021-136250

(51) Int. Cl.
*G03G 15/08* (2006.01)
*G03G 21/16* (2006.01)

(52) U.S. Cl.
CPC ..... *G03G 15/0863* (2013.01); *G03G 15/0887* (2013.01); *G03G 21/1657* (2013.01); *G03G 21/1676* (2013.01); *G03G 2215/0697* (2013.01)

(58) Field of Classification Search
CPC ..... G03G 15/0863; G03G 15/0887; G03G 21/1657; G03G 21/1676; G03G 2215/0695; G03G 2215/0697
See application file for complete search history.

(56) References Cited

U.S. PATENT DOCUMENTS

2002/0021909 A1* 2/2002 Harumoto ..... G03G 15/0863 399/24
2004/0228641 A1* 11/2004 Rommelmann ... G03G 15/0863 399/12
2006/0051106 A1* 3/2006 Takahashi ..... G03G 15/0863 399/27
2006/0153578 A1* 7/2006 May ..... G03G 15/0863 399/24
2008/0107441 A1* 5/2008 Tanaka ..... G03G 15/0863 399/83
2010/0119264 A1* 5/2010 Yamaguchi ..... G03G 15/0863 399/262
2011/0176818 A1* 7/2011 Yamamoto ..... G03G 15/0863 399/12
2018/0052414 A1* 2/2018 Yoshii ..... G03G 21/1657

FOREIGN PATENT DOCUMENTS

JP 2007148006 A 6/2007

* cited by examiner

*Primary Examiner* — Sophia S Chen
(74) *Attorney, Agent, or Firm* — Alleman Hall Creasman & Tuttle LLP

(57) ABSTRACT

A developer supplying apparatus includes an attaching portion, an antenna, and a positional relationship changing portion. A developer storage portion including a wireless tag is attached to the attaching portion. The antenna is used for performing wireless communication with the wireless tag of the developer storage portion attached to the attaching portion using a radio wave method. The positional relationship changing portion changes a positional relationship between the wireless tag and the antenna.

9 Claims, 6 Drawing Sheets

DEVELOPER SUPPLYING APPARATUS THAT COMMUNICATES WITH WIRELESS TAG, IMAGE FORMING APPARATUS, AND DEVELOPER STORAGE CONTAINER

INCORPORATION BY REFERENCE

This application is based upon and claims the benefit of priority from the corresponding Japanese Patent Application No. 2021-136250 filed on Aug. 24, 2021, the entire contents of which are incorporated herein by reference.

BACKGROUND

The present disclosure relates to an image forming apparatus that forms an image using developer, a developer supplying apparatus provided in the image forming apparatus, and a developer storage container.

In an image forming apparatus that forms an image using developer such as toner, a developer storage portion that stores the developer is provided detachably. In addition, there is known an image forming apparatus that accesses, using an antenna provided opposed to a wireless tag provided in the developer storage portion, the wireless tag by an electromagnetic induction method.

SUMMARY

A developer supplying apparatus according to one aspect of the present disclosure includes an attaching portion, an antenna, and a positional relationship changing portion. A developer storage portion including a wireless tag is attached to the attaching portion. The antenna is used for performing wireless communication with the wireless tag of the developer storage portion attached to the attaching portion using a radio wave method. The positional relationship changing portion changes a positional relationship between the wireless tag and the antenna.

An image forming apparatus according to another aspect of the present disclosure includes the developer supplying apparatus and forms an image using developer supplied by the developer supplying apparatus.

A developer storage container according to another aspect of the present disclosure includes a developer storage portion and a wireless tag. The developer storage portion is cylindrical and conveys, by being rotated along a circumferential direction, developer stored inside in a conveying direction along a rotation shaft. The wireless tag is provided apart from the rotation shaft in the developer storage portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. In addition, the claimed subject matter is not limited to implementations that solve any or all disadvantages noted in any part of this disclosure.

DETAILED DESCRIPTION

Hereinafter, an embodiment of the present disclosure will be described with reference to the attached drawings. It is noted that the following embodiment is an embodied example of the present disclosure and does not limit the technical scope of the present disclosure.

[Configuration of Image Forming Apparatus 100]

Figure 1:
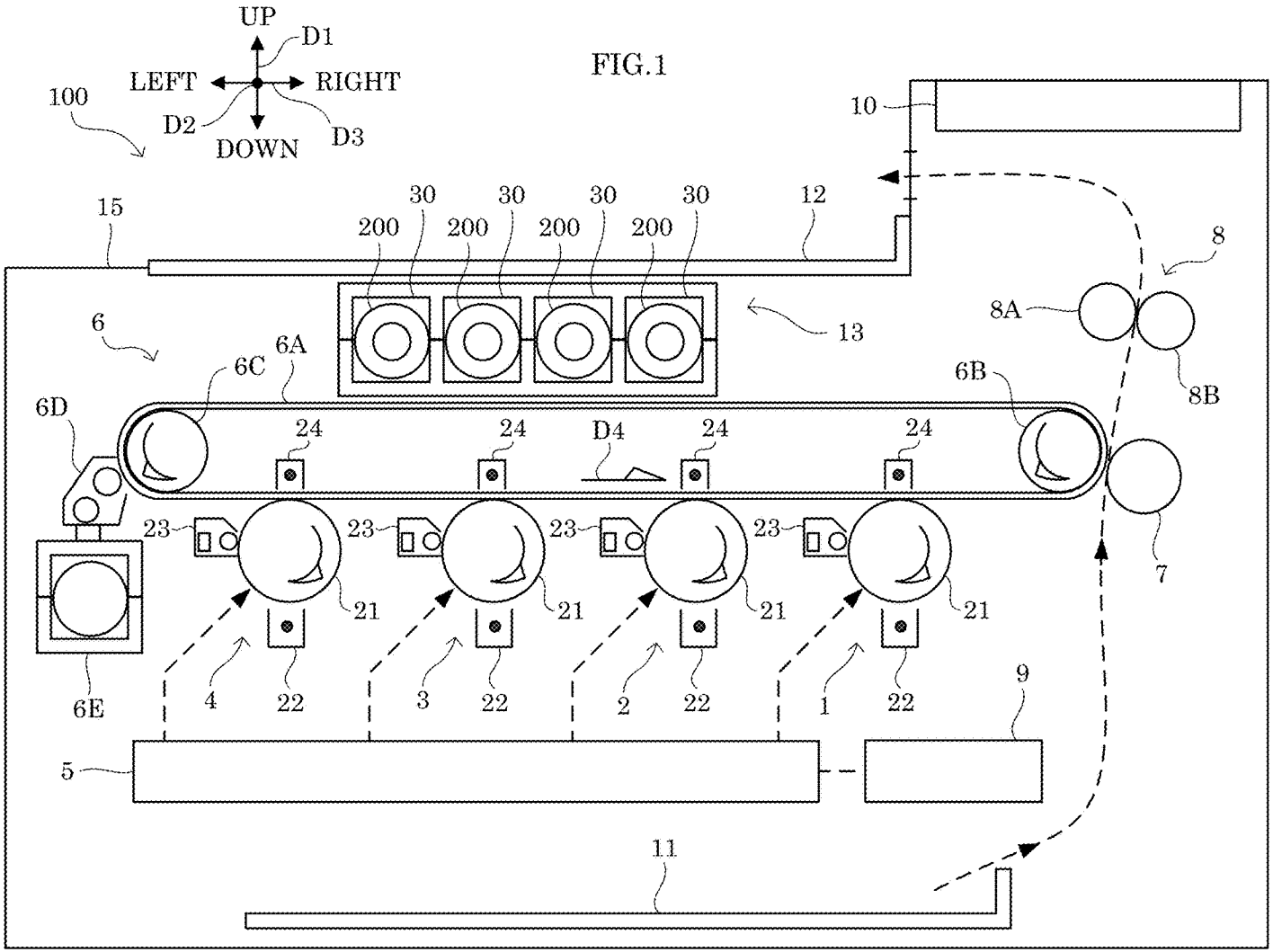
FIG. 1 is a diagram showing a configuration of an image forming apparatus according to an embodiment of the present disclosure.

First, a configuration of an image forming apparatus 100 according to the embodiment of the present disclosure will be described with reference to FIG. 1 and FIG. 2. It is noted that FIG. 1 is a cross-sectional view showing the configuration of the image forming apparatus 100.

It is noted that in descriptions hereinafter, an up-down direction D1 is defined based on the state where the image forming apparatus 100 is installed. In addition, a front-rear direction D2 is defined such that a side of the image forming apparatus 100 on which a toner storage container 200 is to be inserted is a front side (front surface side). In addition, a left-right direction D3 is defined in a state where the image forming apparatus 100 is seen from the front side (front surface side).

The image forming apparatus 100 is an apparatus that includes at least a printing function. The image forming apparatus 100 uses developer including toner (an example of developer of the present disclosure) to print an image on a printing sheet as a sheet member. The image forming apparatus 100 is, e.g., a color printer. It is noted that the image forming apparatus 100 may be a monochrome printer, or may be a facsimile apparatus, a copying machine, a multifunction peripheral, or the like.

The image forming apparatus 100 is a so-called tandem-type color image forming apparatus. As shown in FIG. 1 and FIG. 2, the image forming apparatus 100 includes a plurality of image forming portions 1 to 4, a laser scanning unit 5, an intermediate transfer unit 6, a secondary transfer device 7, a fixing device 8, a control portion 9, an operation display portion 10, a paper feed tray 11, a sheet discharge tray 12, a toner supplying portion 13, and a wireless communication portion 14. These structural elements are attached to a casing 15 structuring an external frame (not shown), an internal frame, and the like of the image forming apparatus 100. The apparatus including the control portion 9, the toner supplying portion 13, and the wireless communication portion 14 is an example of a developer supplying apparatus according to the present disclosure.

The image forming portions 1 to 4 respectively form toner images of different colors on a plurality of photoconductor drums 21 provided adjacently by so-called electrophotography. The toner images are transferred so as to be sequentially superimposed on one another on a running (moving) intermediate transfer belt 6A. As shown in FIG. 1, the image forming portions 1 to 4 are arranged such that a black-color image forming portion 1, a yellow-color image forming portion 2, a cyan-color image forming portion 3, and a magenta-color image forming portion 4 are sequentially arranged in line in the stated order from a downstream side of a moving direction D4 of the intermediate transfer belt 6A.

The image forming portions 1 to 4 are each provided below the intermediate transfer belt 6A. Each of the image forming portions 1 to 4 includes a photoconductor drum 21 that carries a toner image, a charging device 22, a developing device 23, a primary transfer device 24, and the like. A surface of the photoconductor drum 21 is charged by the charging device 22, and the charged surface of the photoconductor drum 21 is subjected to exposure scanning by the laser scanning unit 5. Thus, an electrostatic latent image is formed on the surface of the photoconductor drum 21. The developing device 23 develops the electrostatic latent image using a toner. The primary transfer device 24 transfers the toner image on the photoconductor drum 21 onto the intermediate transfer belt 6A.

The intermediate transfer unit 6 includes the intermediate transfer belt 6A, a drive roller 6B, a driven roller 6C, and a belt cleaning device 6D. The intermediate transfer belt 6A carries a toner image obtained from toner images of a plurality of colors (four colors in the present embodiment). Because the intermediate transfer belt 6A is supported by the drive roller 6B and the driven roller 6C such that the intermediate transfer belt 6A can be driven rotationally, the intermediate transfer belt 6A can move while the surface thereof is in contact with the surfaces of the respective photoconductor drums 21. When the intermediate transfer belt 6A is driven rotationally, the surface thereof is passed between the photoconductor drums 21 and the primary transfer devices 24. At this time, the toner images of the respective colors carried by the plurality of photoconductor drums 21 are sequentially superimposed on one another to thus be transferred onto the intermediate transfer belt 6A.

The toner supplying portion 13 is provided above the intermediate transfer unit 6. The toner supplying portion 13 supplies the toner of corresponding colors to the image forming portions 1 to 4, respectively.

The secondary transfer device 7 transfers the toner image transferred onto the intermediate transfer belt 6A onto a printing sheet conveyed from the paper feed tray 11. The printing sheet onto which the toner image is transferred is conveyed to the fixing device 8 by a conveying portion not shown. The fixing device 8 includes a heating roller 8A and a pressure roller 8B. The fixing device 8 conveys the printing sheet onto which the toner image is transferred while heating and pressurizing the printing sheet. Thus, the toner image is melted to be fixed onto the printing sheet. The printing sheet onto which the toner image is fixed is conveyed further to the downstream side to be discharged to and held by the tray-type sheet discharge tray 12 provided above the intermediate transfer unit 6.

The belt cleaning device 6D removes and collects waste toner remaining on the surface of the intermediate transfer belt 6A and discharges the collected waste toner to a waste toner container 6E.

The control portion 9 collectively controls the image forming apparatus 100. As shown in FIG. 2, the control portion 9 includes a CPU 9A, a ROM 9B, and a RAM 9C. The CPU 9A is a processor that executes various types of arithmetic processing. The ROM 9B is a nonvolatile storage device in which information such as control programs for causing the CPU 9A to execute various types of processing is stored in advance. The RAM 9C is a volatile or nonvolatile storage device that is used as a temporary storage memory (working area) for the various types of processing to be executed by the CPU 9A. The CPU 9A collectively controls the image forming apparatus 100 by executing the various types of control programs stored in advance in the ROM 9B.

It is noted that the control portion 9 may be a control portion provided separate from a main control portion that collectively controls the image forming apparatus 100. In addition, the control portion 9 may be structured by an electronic circuit such as an integrated circuit (ASIC).

The operation display portion 10 includes a display portion and an operation portion, wherein the display portion is, for example, a liquid crystal display and displays various types of information in accordance with control instructions from the control portion 9, and the operation portion is, for example, operation keys and a touch panel and is used for inputting various types of information to the control portion 9 in accordance with user operations.

The wireless communication portion 14 executes wireless communication with a wireless tag 203 (see FIG. 2) provided in the toner storage container 200 (see FIG. 1). The wireless communication portion 14 is a reader/writer capable of reading/writing from/to the wireless tag 203.

Figure 2:
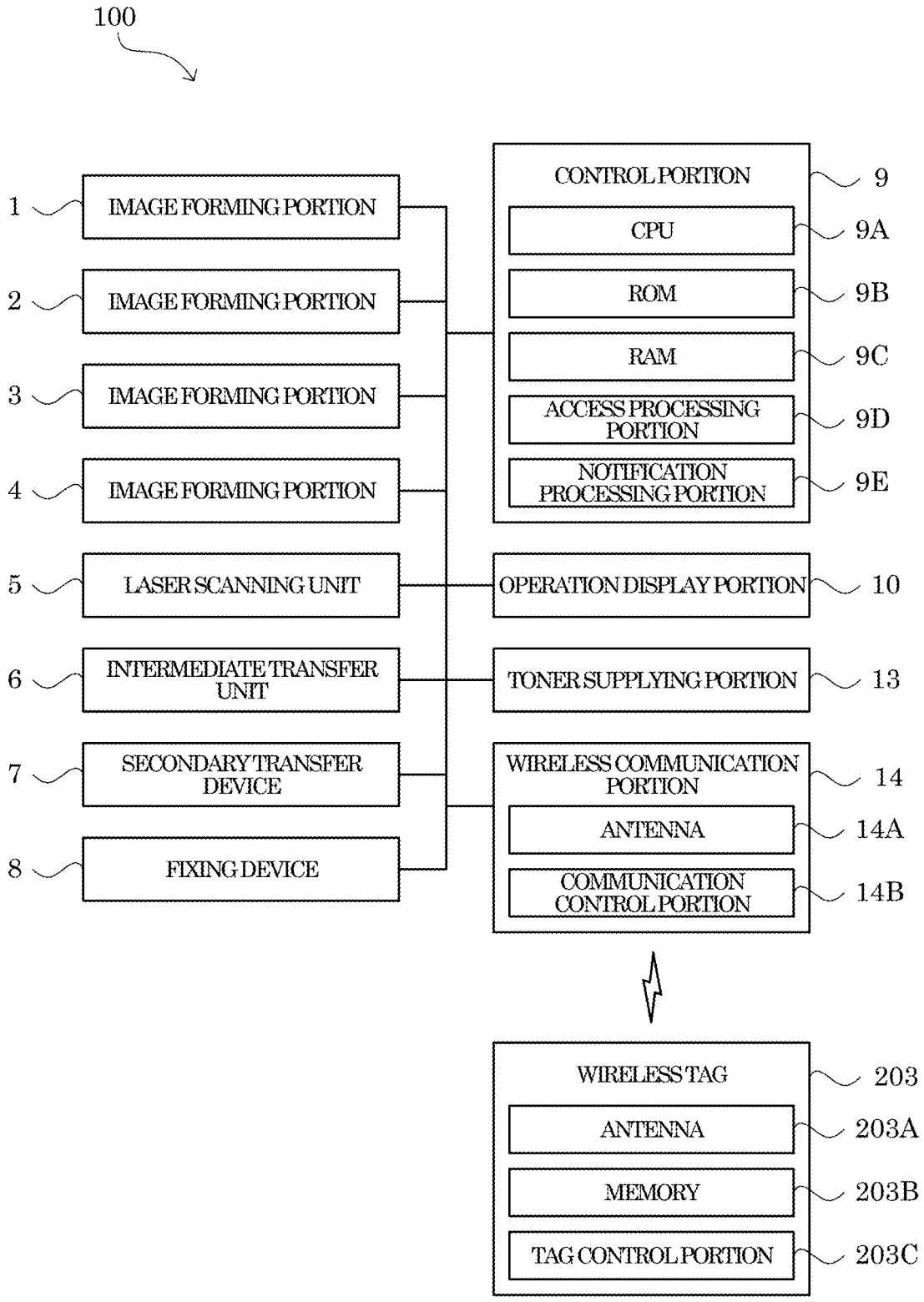
FIG. 2 is a block diagram showing a system configuration of the image forming apparatus according to the embodiment of the present disclosure.

As shown in FIG. 2, the wireless communication portion 14 includes an antenna 14A (an example of an antenna of the present disclosure) and a communication control portion 14B. The antenna 14A is used for the wireless communication with the wireless tag 203 (see FIG. 2) of the toner storage container 200 attached to an attaching portion 30 (see FIG. 1). The communication control portion 14B uses the antenna 14A to execute wireless communication with the wireless tag 203. The antenna 14A and the communication control portion 14B are mounted on a substrate 14C (see FIG. 3). It is noted that the antenna 14A may be provided on a substrate or the like that is different from the substrate on which the communication control portion 14B is mounted.

[Configuration of Toner Supplying Portion 13]

Figure 3:
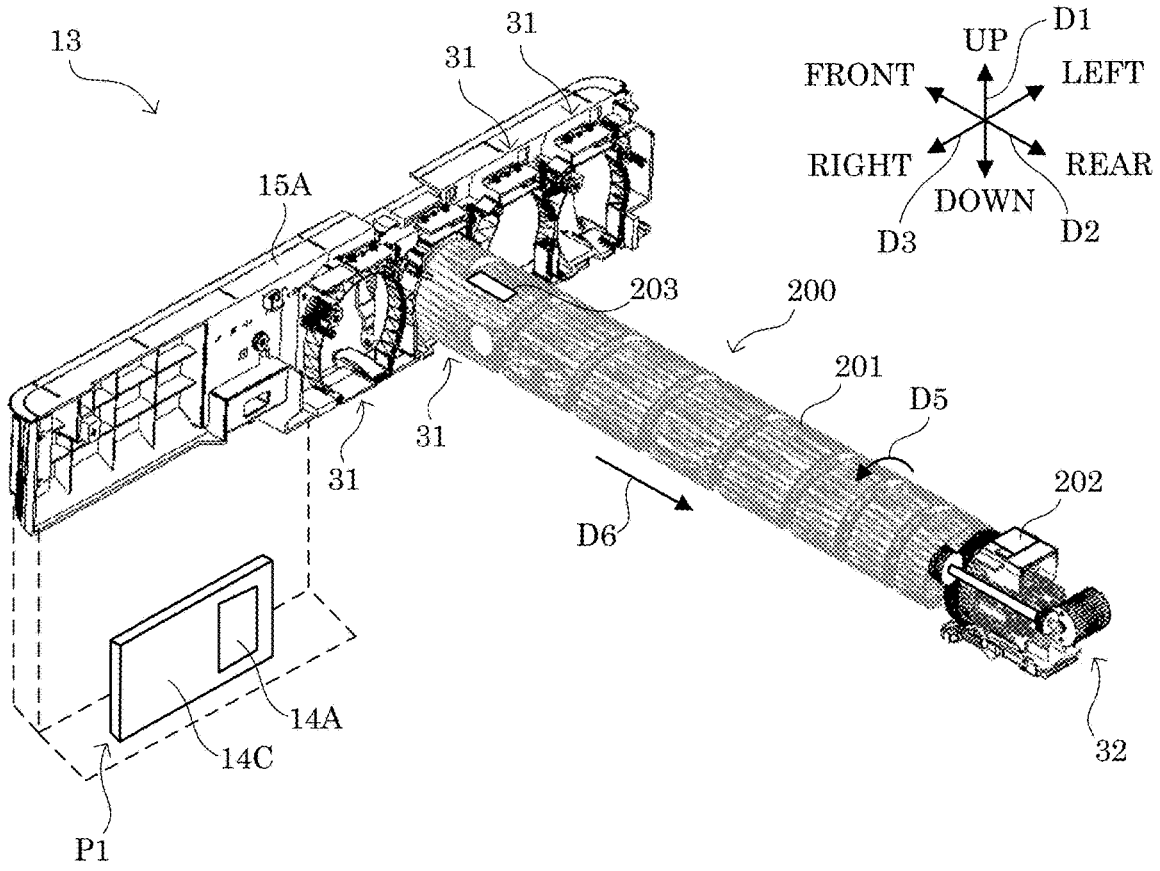
FIG. 3 is a diagram showing a configuration of a toner supplying portion of the image forming apparatus according to the embodiment of the present disclosure.
Figure 4:
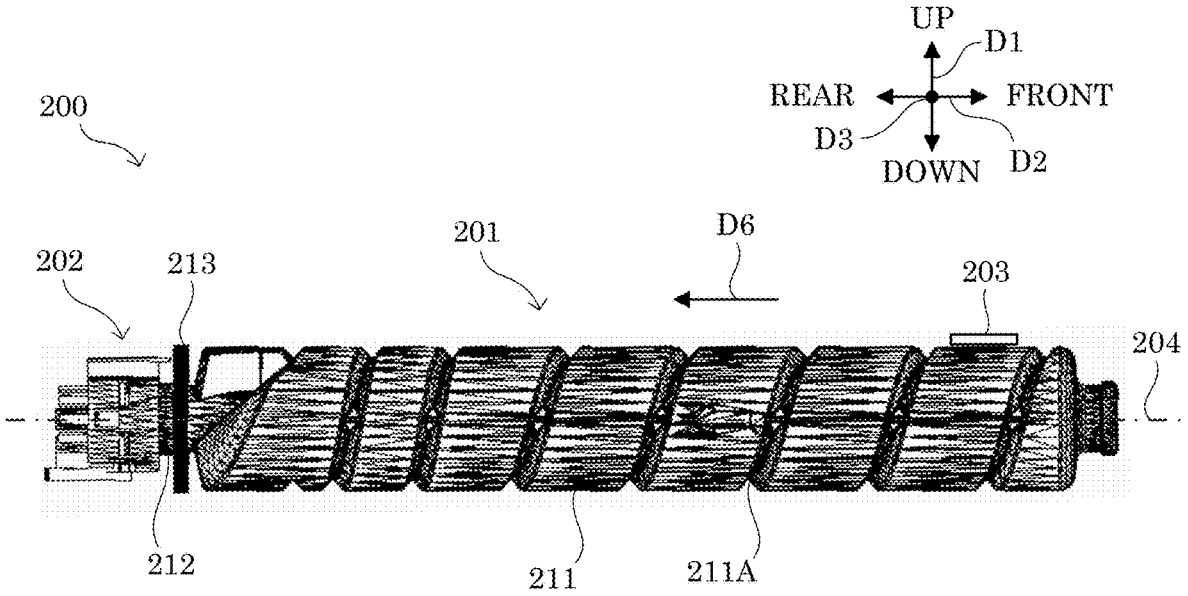
FIG. 4 is a diagram showing a configuration of a toner storage container of the image forming apparatus according to the embodiment of the present disclosure.
Figure 5:
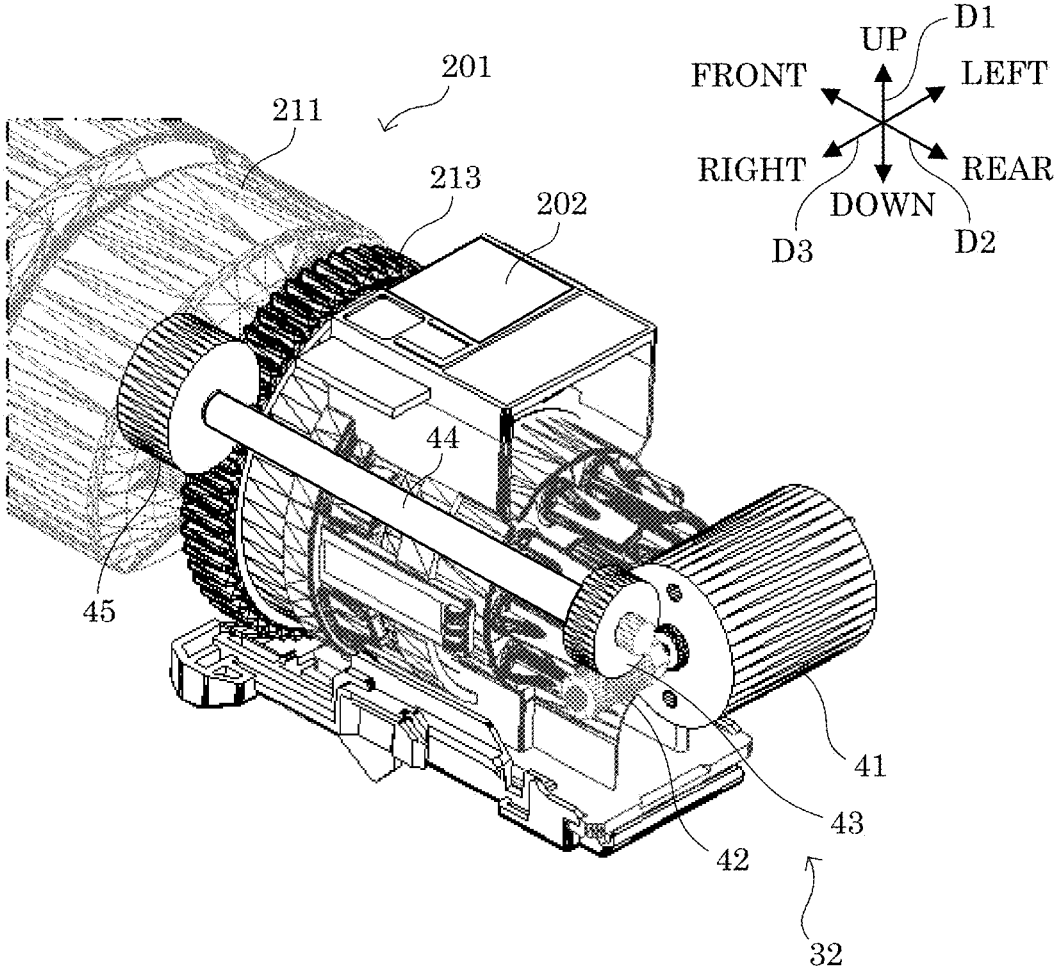
FIG. 5 is a diagram showing a configuration of a driving portion of the image forming apparatus according to the embodiment of the present disclosure.

Next, the toner supplying portion 13 will be described with reference to FIG. 1 to FIG. 5. It is noted that FIG. 3 is a perspective view showing a configuration of the toner supplying portion 13. In addition, FIG. 4 is a side view showing a configuration of the toner storage container 200. In addition, FIG. 5 is a perspective view showing a configuration of a drive portion 32. It is noted that the broken lines of FIG. 3 are auxiliary lines for indicating a position of the substrate 14C with respect to the wireless tag 203.

As shown in FIG. 1, the toner supplying portion 13 includes the toner storage containers 200 (an example of a developer storage container of the present disclosure) corresponding to the respective colors of black, yellow, cyan, and magenta, and the attaching portions 30 to which the toner storage containers 200 are to be attached respectively.

In addition, as shown in FIG. 3, the toner supplying portion 13 includes opening portions 31 and the drive portions 32.

The toner storage containers 200 respectively store the toner to be supplied to the developing devices 23. In the present embodiment, four toner storage containers 200 corresponding to the respective colors of black, yellow, cyan, and magenta are provided in the toner supplying portion 13. FIG. 3 shows only the yellow toner storage container 200, and illustrations of the toner storage containers 200 of other colors are omitted. The toner storage containers 200 of the respective colors have a common configuration except that an outer diameter of the black toner storage container 200 is larger than that of the toner storage containers 200 of the other colors. Hereinafter, unless noted specifically, descriptions will be given on the yellow toner storage container 200 shown in FIG. 3 and configurations corresponding to that toner storage container 200.

As shown in FIG. 4, the toner storage container 200 includes a container main body 201 (an example of a developer storage portion of the present disclosure), a cap portion 202, and the wireless tag 203.

The container main body 201 stores the toner. The container main body 201 is cylindrical and is rotated in a rotation direction D5 (see FIG. 3) along a circumferential direction to convey the toner stored inside in a conveying direction D6 (see FIG. 3 and FIG. 4) along a rotation shaft 204 (see FIG. 4). The rotation shaft 204 is a shaft line that passes a center of the container main body 201. The conveying direction D6 is a direction that is directed from a front surface (front side) of the image forming apparatus 100 toward a rear surface (back surface) thereof. The container main body 201 is integrally formed by a synthetic resin such as polyethylene terephthalate (PET resin).

As shown in FIG. 4, the container main body 201 includes a storing portion 211, an opening portion 212, and a gear portion 213.

The storing portion 211 is formed cylindrically while being concentric with the rotation shaft 204 of the toner storage container 200 (see FIG. 4). Refill toner is stored inside the storing portion 211. At an inner circumferential portion of the storing portion 211, a protrusion portion 211A (see FIG. 4) formed spirally along the rotation shaft 204 is provided. The protrusion portion 211A protrudes toward the rotation shaft 204 from an inner circumferential surface of the storing portion 211. FIG. 4 shows a spiral concave portion formed on an outer circumferential portion of the storing portion 211 in correspondence with the protrusion portion 211A. Since the spiral protrusion portion 211A is formed inside, the storing portion 211 is capable of conveying the toner stored inside in the conveying direction D6 along the rotation shaft 204 by being rotated in the rotation direction D5 (see FIG. 3) about the rotation shaft 204.

The opening portion 212 is provided at an end of the container main body 201 on the downstream side of the conveying direction D6. The opening portion 212 is formed to protrude in a cylindrical shape while being concentric with the rotation shaft 204, from an end of the storing portion 211 on the downstream side of the conveying direction D6 toward the downstream side of the conveying direction D6. The opening portion 212 is opened in the conveying direction D6. The toner inside the container main body 201 is discharged from the opening portion 212 in the conveying direction D6.

The gear portion 213 is provided at an outer circumferential portion of the opening portion 212 formed cylindrically. The gear portion 213 receives a rotational driving force supplied from the drive portion 32. The container main body 201 is obtained by integrally forming the respective configurations including the gear portion 213. Therefore, as the gear portion 213 receives the rotational driving force supplied from the drive portion 32, the container main body 201 rotates about the rotation shaft 204.

The cap portion 202 is attached to a rear end of the container main body 201, that is, the opening portion 212. The cap portion 202 is formed cylindrically while being opened in one direction, in a size with which a part of the cylindrically-formed opening portion 212 can be covered. The cap portion 202 rotatably supports the cylindrically-formed opening portion 212.

The cap portion 202 downwardly guides the toner discharged from the opening portion 212 at a position more on the downstream side of the conveying direction D6 than the opening portion 212. A guide space for downwardly guiding the toner discharged from the opening portion 212 is formed inside the cap portion 202. An outlet from which the toner is discharged outside the cap portion 202 is formed at a bottom portion of an inner circumferential portion of the cap portion 202.

The wireless tag 203 is used for reading/writing specific information related to the toner storage container 200. The wireless tag 203 is also called an RFID (Radio Frequency Identification) tag. The wireless tag 203 is a so-called passive-type wireless tag and operates by power supplied from the antenna 14A of the wireless communication portion 14.

The specific information includes individual identification information, manufacturer information, and information on a manufacturing date and the like of the toner storage container 200. In addition, the specific information includes information on a type, color, storing amount at the time of factory shipment, current storing amount, and the like of the toner stored in the toner storage container 200.

As shown in FIG. 2, the wireless tag 203 includes an antenna 203A, a memory 203B, and a tag control portion 203C. The antenna 203A is used to perform wireless communication with the wireless communication portion 14. The memory 203B stores the specific information. The tag control portion 203C executes wireless communication with the wireless communication portion 14 using the antenna 203A. In addition, the tag control portion 203C executes reading/writing of data from/to the memory 203B based on instructions from the wireless communication portion 14.

The toner storage container 200 is attached to the attaching portion 30. The attaching portions 30 are provided in correspondence with the respective toner storage containers 200. Each of the attaching portions 30 forms a housing space for the toner storage container 200 extending in the front-rear direction D2 inside the casing 15. The toner storage container 200 is attached to the attaching portion 30 in an attitude in which the rotation shaft 204 becomes horizontal.

The opening portions 31 are provided on a side surface of the casing 15 of the image forming apparatus 100. Specifically, the opening portions 31 are provided on a front surface (front side) of the casing 15. A frame member 15A (see FIG. 3) that is elongated in the left-right direction D3 is provided on the front surface of the casing 15. The opening portions 31 are formed on the frame member 15A. The opening portions 31 are provided in correspondence with the respective attaching portions 30. The opening portion 31 is positioned at a front end of the attaching portion 30 and is in communication with the attaching portion 30. The toner storage containers 200 are respectively inserted into the opening portions 31.

The drive portion 32 causes the container main body 201 of the toner storage container 200 to rotate. The drive portions 32 are provided in correspondence with the respective attaching portions 30. Each of the drive portions 32 is provided at a rear end of the attaching portion 30 (FIG. 3).

As shown in FIG. 5, the drive portion 32 includes a motor 41, a first gear 42, a second gear 43, a shaft 44, and a third gear 45. The first gear 42 is fixed to a driving shaft of the motor 41. The second gear 43 is fixed to one end of the shaft 44 and interlocks with the first gear 42. The shaft 44 is rotatably supported by a bearing (not shown) inside the casing 15. The third gear 45 is fixed to the other end of the shaft 44 and interlocks with the gear portion 213 of the container main body 201.

In the drive portion 32, the rotational driving force generated by the motor 41 is transmitted to the gear portion 213 via the first gear 42, the second gear 43, the shaft 44, and the third gear 45. Thus, the container main body 201 rotates about the rotation shaft 204.

Meanwhile, there is known an image forming apparatus that accesses the wireless tag 203 by an electromagnetic induction method using the antenna 14A arranged opposed to the wireless tag 203. The electromagnetic induction method is a communication method that realizes power supply and information transmission by an action of a magnetic field generated in either one of the antenna 203A and the antenna 14A to the other one of the antennas. A communication distance in the electromagnetic induction method is generally several centimeters or ten and several centimeters.

Here, in the image forming apparatus, by switching the communication method for the wireless communication with the wireless tag 203, from the electromagnetic induction method to the radio wave method, the communication distance in the wireless communication can be set to be long. Thus, a degree of freedom in arranging the antenna 14A is raised. The radio wave method is a communication method that realizes power supply and information transmission using radio waves transmitted from either one of the antenna 203A and the antenna 14A to the other one of the antennas. The communication distance in the radio wave method is generally several meters or ten and several meters.

However, in a case where the antenna 14A is positioned apart from the wireless tag 203, the wireless communication with the wireless tag 203 may become unstable due to metal existing inside the casing 15. For example, in a case where metal exists between the antenna 14A and the wireless tag 203, radio waves are reflected by the metal, with the result that the wireless communication between the antenna 14A and the wireless tag 203 becomes unstable. In addition, even in a case where metal does not exist between the antenna 14A and the wireless tag 203, in a case where metal exists in a periphery of the antenna 14A or the wireless tag 203, radio waves are reflected by the metal, and thus there is a fear that the wireless communication between the antenna 14A and the wireless tag 203 may become unstable.

In contrast, in the image forming apparatus 100 according to the embodiment of the present disclosure, it is possible to raise the degree of freedom in arranging the antenna 14A as well as suppress unstable communication with the wireless tag 203 provided in the toner storage container 200 as will be described hereinafter.

In the image forming apparatus 100, wireless communication that uses the radio wave method is executed between the wireless communication portion 14 and the wireless tag 203. Thus, a raise in the degree of freedom in arranging the antenna 14A is realized. In addition, the wireless tag 203 can also be accessed from outside the image forming apparatus 100.

Specifically, the wireless communication portion 14 and the wireless tag 203 execute wireless communication using radio waves having a frequency of 860 to 960 MHz (megahertz) (UHF band) on the basis of an ISO (International Organization for Standardization) 18000-6 communications standard. It is noted that the wireless communication portion 14 and the wireless tag 203 may execute wireless communication using radio waves having a frequency of 2.45 GHz (gigahertz) (microwave band) on the basis of an ISO 18000-4 communications standard.

In addition, in the image forming apparatus 100, a positional relationship between the wireless tag 203 and the antenna 14A can be changed. Thus, suppression of unstable wireless communication between the wireless tag 203 and the antenna 14A can be realized.

Specifically, the wireless tag 203 is provided on an outer circumferential surface of the container main body 201 (see FIG. 3 and FIG. 4). In addition, the antenna 14A is fixedly arranged inside the casing 15 (see FIG. 3). Thus, when the container main body 201 is rotated by the drive portion 32, the wireless tag 203 is also rotated along with the container main body 201, and a relative positional relationship between the wireless tag 203 and the antenna 14A fluctuates by a rotation period of the container main body 201. The drive portion 32 is an example of a positional relationship changing portion according to the present disclosure.

Here, the wireless tag 203 is provided on an upstream side of the conveying direction D6 in the container main body 201. For example, as shown in FIG. 3, the wireless tag 203 is provided at an end of the container main body 201 on the upstream side of the conveying direction D6.

In addition, the antenna 14A is provided on the upstream side of the conveying direction D6 from the wireless tag 203. For example, the antenna 14A is provided at a specific position P1 (see FIG. 3) set on a plane that is orthogonal to the conveying direction D6 and passes through the wireless tag 203. For example, as shown in FIG. 3, the specific position P1 is a position that is lower than that of the container main body 201 and more on the right-hand side than the container main body 201.

In the toner storage container 200, the toner stored inside is conveyed in the conveying direction D6. Therefore, the end of the container main body 201 on the upstream side of the conveying direction D6 becomes empty immediately after the toner storage container 200 is started to be used. In other words, by arranging the wireless tag 203 and the antenna 14A as described above, it becomes possible to shorten a period during which the toner exists in the container main body 201 at a position between the wireless tag 203 and the antenna 14A while the toner storage container 200 is being used. Therefore, it becomes possible to suppress inhibition of the wireless communication between the wireless communication portion 14 and the wireless tag 203 due to metal components included in the toner stored inside the container main body 201.

It is noted that the wireless tag 203 may be provided more on the downstream side of the conveying direction D6 than the end of the container main body 201 on the upstream side of the conveying direction D6. In addition, the antenna 14A may be provided more on the downstream side of the conveying direction D6 than the wireless tag 203.

In addition, the wireless tag 203 may be provided at a position different from the outer circumferential surface of the container main body 201. For example, the wireless tag 203 may be provided on an end surface of the container main body 201 on the upstream side of the conveying direction D6 while being apart from the rotation shaft 204. The wireless tag 203 only needs to be provided apart from the rotation shaft 204.

In addition, the substrate 14C may be provided while being movable along any of the up-down direction D1, the front-rear direction D2, and the left-right direction D3 from the specific position P1 (see FIG. 3) by the rotational driving force of the motor or the like. In this case, the wireless tag 203 may be provided at a position on the rotation shaft 204, or may be provided in the cap portion 202. In this case, the motor is another example of the positional relationship changing portion according to the present disclosure. In other words, the positional relationship changing portion according to the present disclosure only needs to be capable of moving either one or both of the wireless tag 203 and the antenna 14A so as to change the relative positional relationship therebetween.

[Configuration of Control Portion 9]

Next, the configuration of the control portion 9 will be described with reference to FIG. 2.

As shown in FIG. 2, the control portion 9 includes an access processing portion 9D and a notification processing portion 9E.

Specifically, an access control program for causing the CPU 9A to function as the respective portions described above is stored in advance in the ROM 9B of the control portion 9. By executing the access control program stored in the ROM 9B, the CPU 9A functions as the access processing portion 9D and the notification processing portion 9E.

It is noted that the access control program may be recorded onto a computer-readable recording medium such as a CD, a DVD, and a flash memory and read out from the recording medium to be stored in a storing device provided inside the casing 15. In addition, the access processing portion 9D and the notification processing portion 9E may be structured by an electronic circuit such as an integrated circuit (ASIC).

The access processing portion 9D accesses the wireless tag 203 using the antenna 14A while supply processing is being executed, wherein in the supply processing, the container main body 201 of the toner storage container 200 is caused to rotate to supply the toner to the developing device 23. In other words, reading/writing of data from/to the wireless tag 203 is executed.

The supply processing is executed in accordance with a toner consumption within the developing device 23 while print processing is being executed.

For example, the access processing portion 9D reads out the specific information from the wireless tag 203 using the wireless communication portion 14 in a case where execution of the supply processing is started while the print processing is being executed. In addition, the access processing portion 9D calculates a toner amount after the execution of the print processing, based on a current toner amount included in the read-out specific information and an amount of toner to be consumed in the print processing. In addition, the access processing portion 9D writes the calculated toner amount to the wireless tag 203 as the current toner amount and thus updates the specific information stored in the wireless tag 203.

In a case where an access to the wireless tag 203 by the access processing portion 9D does not succeed before a preset reference time elapses since a start of the access to the wireless tag 203, the notification processing portion 9E makes a notification to that effect.

The reference time may be a time preset irrevocably, or may be a time that is changed arbitrarily in accordance with operations to the operation display portion 10.

For example, the notification processing portion 9E causes the operation display portion 10 to display an error message including the fact that the wireless tag 203 cannot be accessed. It is noted that the error message may include a fact that there is a possibility of a failure in the drive portion 32. In addition, the notification processing portion 9E may notify the fact that the wireless tag 203 cannot be accessed using ringing of an alarm sound, lighting of an alarm light, and the like.

It is noted that the control portion 9 does not need to include the notification processing portion 9E. In addition, the control portion 9 does not need to include both the access processing portion 9D and the notification processing portion 9E. In this case, the control portion 9 may access the wireless tag 203 in accordance with a user operation and cause, in a case where the access does not succeed, the container main body 201 to rotate so as to change the relative positional relationship between the wireless tag 203 and the antenna 14A.

[Access Control Processing]

Figure 6:
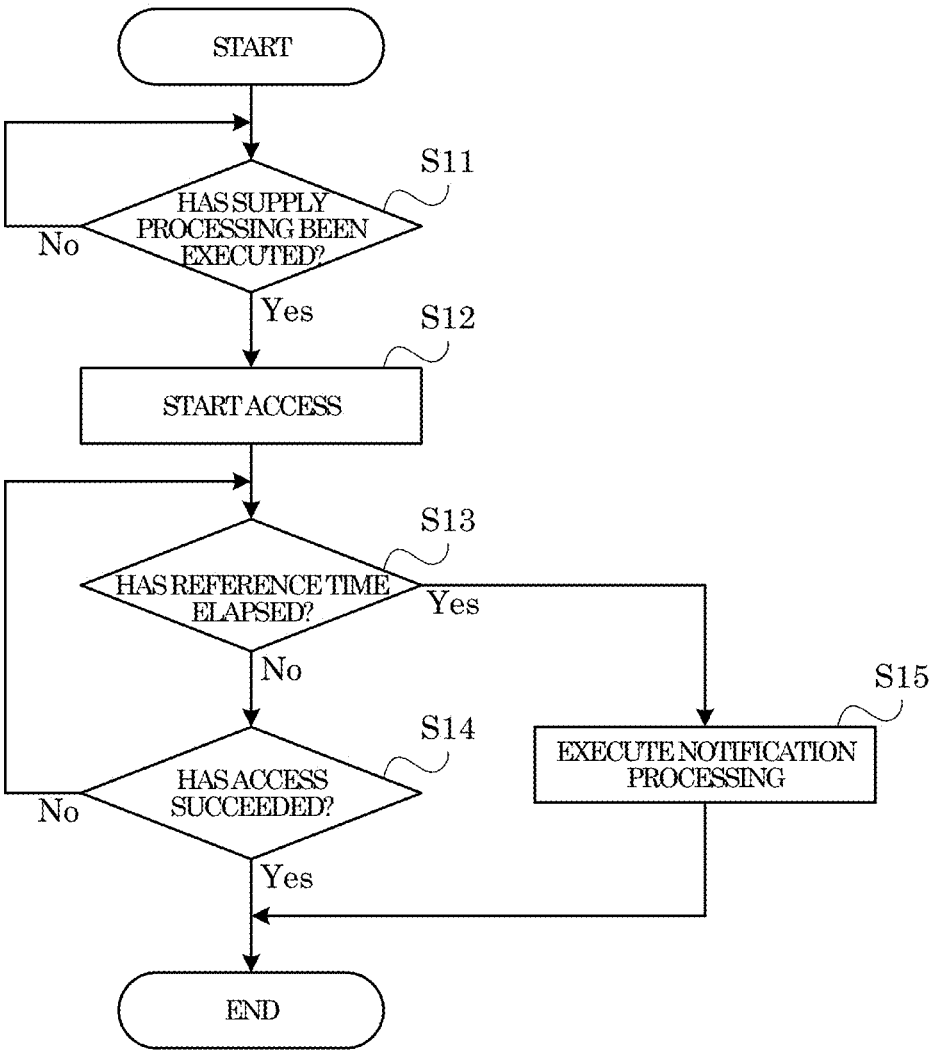
FIG. 6 is a flowchart showing an example of access control processing that is executed by the image forming apparatus according to the embodiment of the present disclosure.

Hereinafter, an example of procedures of the access control processing that is executed by the control portion 9 in the image forming apparatus 100 will be described with reference to FIG. 6. Here, Steps S11, S12, . . . represent numbers allocated to processing procedures (steps) that are executed by the control portion 9. It is noted that in a case where the print processing is executed, the access control processing is executed as the print processing is started.

<Step S11>

First, in Step S11, the control portion 9 determines whether execution of the supply processing has been started.

Here, upon determining that the execution of the supply processing has been started (Yes in S11), the control portion 9 advances the processing to Step S12. In addition, when determining that the execution of the supply processing has not been started (No in S11), the control portion 9 stands by until the execution of the supply processing is started in Step S11.

<Step S12>

In Step S12, the control portion 9 starts accessing the wireless tag 203 using the wireless communication portion 14. Here, the processing of Steps S11 and S12 is executed by the access processing portion 9D of the control portion 9.

<Step S13>

In Step S13, the control portion 9 determines whether the reference time has elapsed since the execution of the processing of Step S12.

Here, upon determining that the reference time has elapsed (Yes in S13), the control portion 9 advances the processing to Step S15. In addition, upon determining that the reference time has not elapsed (No in S13), the control portion 9 advances the processing to Step S14.

<Step S14>

In Step S14, the control portion 9 determines whether the access to the wireless tag 203 using the wireless communication portion 14 has succeeded.

For example, the control portion 9 determines that the access has succeeded in a case where the control portion 9 has succeeded in reading out the specific information from the wireless tag 203. It is noted that in a case where the control portion 9 has succeeded in reading out the specific information, the control portion 9 calculates the toner amount after the execution of the print processing based on the current toner amount included in the read-out specific information and the amount of toner to be consumed in the print processing. The control portion 9 writes the calculated toner amount to the wireless tag 203 as the current toner amount to thus update the specific information stored in the wireless tag 203.

Here, upon determining that the access to the wireless tag 203 has succeeded (Yes in S14), the control portion 9 ends the access control processing. In addition, upon determining that the access to the wireless tag 203 has not succeeded (No in S14), the control portion 9 causes the processing to return to Step S13.

<Step S15>

In Step S15, the control portion 9 executes notification processing for notifying that the access to the wireless tag 203 has not succeeded before the reference time has elapsed since the start of the access to the wireless tag 203. Here, the processing of Step S15 is executed by the notification processing portion 9E of the control portion 9.

For example, the control portion 9 causes the operation display portion 10 to display the error message. Thus, the user can recognize a trouble including the failure of the drive portion 32 and take action to deal with the trouble.

As described above, in the image forming apparatus 100, the wireless communication using the radio wave method is executed between the wireless communication portion 14 and the wireless tag 203. In addition, in the image forming apparatus 100, the relative positional relationship between the wireless communication portion 14 and the wireless tag 203 is changed at a time when the wireless communication is held between the wireless communication portion 14 and the wireless tag 203. Thus, it becomes possible to raise the degree of freedom in arranging the antenna 14A as well as suppress unstable communication with the wireless tag 203 provided in the toner storage container 200.

In addition, in the image forming apparatus 100, the access to the wireless tag 203 using the antenna 14A is executed while executing the supply processing in which the container main body 201 of the toner storage container 200 is rotated to supply the toner to the developing device 23. Thus, it is possible to suppress a state where the container main body 201 is rotated only for accessing the wireless tag 203. In addition, it is possible to suppress a state where the amount of toner inside the developing device 23 becomes excessively large.

It is noted that the developer according to the present disclosure does not need to be limited to the toner. For example, the developer according to the present disclosure may be ink. In other words, the present disclosure may be applied to an image forming apparatus that forms an image by an inkjet method.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising a developer supplying apparatus, comprising:

an attaching portion to which a developer storage portion including a wireless tag is to be attached;

an antenna used for performing wireless communication with the wireless tag of the developer storage portion attached to the attaching portion using a radio wave method; and a positional relationship changing portion that changes a positional relationship between the wireless tag and the antenna, wherein the image forming apparatus forms an image using a developer supplied by the developer supplying apparatus, and the attaching portion is immovably provided inside the image forming apparatus.

2. The image forming apparatus according to claim 1, wherein the developer storage portion is cylindrical and conveys, by being rotated along a circumferential direction, developer stored inside in a conveying direction along a rotation shaft, the wireless tag is provided apart from the rotation shaft, and the positional relationship changing portion causes the developer storage portion attached to the attaching portion to rotate.

3. The image forming apparatus according to claim 2, wherein the wireless tag is provided on an upstream side of the conveying direction in the developer storage portion, and the antenna is provided on the upstream side of the conveying direction from the wireless tag.

4. The image forming apparatus according to claim 2, further comprising an access processing portion that accesses the wireless tag using the antenna while supplying processing for causing the developer storage portion to rotate to supply the developer is being executed.

5. The image forming apparatus according to claim 4, further comprising a notification processing portion that, in a case where an access to the wireless tag does not succeed before a preset reference time elapses since a start of the access to the wireless tag by the access processing portion, makes a notification to that effect.

6. A developer supplying apparatus, comprising:

an attaching portion to which a developer storage portion including a wireless tag is to be attached;

an antenna used for performing wireless communication with the wireless tag of the developer storage portion attached to the attaching portion using a radio wave method;

a positional relationship changing portion that changes a positional relationship between the wireless tag and the antenna; and an access processing portion that accesses the wireless tag using the antenna while supplying processing for causing the developer storage portion to rotate to supply the developer is being executed, wherein the developer storage portion is cylindrical and conveys, by being rotated along a circumferential direction, developer stored inside in a conveying direction along a rotation shaft, the wireless tag is provided apart from the rotation shaft, and the positional relationship changing portion causes the developer storage portion attached to the attaching portion to rotate.

7. The developer supplying apparatus according to claim 6, further comprising a notification processing portion that, in a case where an access to the wireless tag does not succeed before a preset reference time elapses since a start of the access to the wireless tag by the access processing portion, makes a notification to that effect.

8. The developer supplying apparatus according to claim 6, wherein the wireless tag is provided on an upstream side of the conveying direction in the developer storage portion, and the antenna is provided on the upstream side of the conveying direction from the wireless tag.

9. An image forming apparatus, comprising the developer supplying apparatus according to claim 6, wherein the image forming apparatus forms an image using developer supplied by the developer supplying apparatus.

* * * * *